US005535557A

United States Patent [19]

Garber

[11] Patent Number: 5,535,557

[45] Date of Patent: Jul. 16, 1996

[54] NON-LAMINATED, SELF-CONFIGURING, VARIABLE PITCH SPIRAL STAIRSET AND METHOD OF FABRICATING SPIRAL STAIRWAY

[75] Inventor: Thomas R. Garber, Sevierville, Tenn.

[73] Assignee: Precision Pine, Inc., Sevierville, Tenn.

[21] Appl. No.: 348,495

[22] Filed: Dec. 2, 1994

[51] Int. Cl.[6] ..... E04F 11/00

[52] U.S. Cl. ..... 52/187; 52/182; 52/183; 52/191; 52/223.7

[58] Field of Search ..... 52/187, 188, 182, 52/184, 223.4, 223.7, 223.14, 183, 191

[56] References Cited

U.S. PATENT DOCUMENTS

| | | | |
|---|---|---|---|
| 400,470 | 4/1889 | Marshall . | |
| 736,399 | 8/1903 | Horn . | |
| 1,446,454 | 2/1923 | Fischer . | |
| 2,471,352 | 5/1949 | Safir . | |
| 3,021,928 | 2/1962 | Blair . | |
| 3,168,170 | 2/1965 | Thom . | |
| 3,418,770 | 12/1968 | Allmand | 52/187 |
| 3,421,559 | 1/1969 | Frano . | |
| 3,491,498 | 1/1970 | Hughes . | |
| 3,964,222 | 6/1976 | Geleijnse et al. | 52/187 X |
| 4,587,780 | 5/1986 | Rorke | 52/187 |
| 4,646,490 | 3/1987 | Naka et al. . | |
| 4,660,335 | 4/1987 | Scholler | 52/187 |
| 4,722,374 | 2/1988 | Bond | 52/187 X |
| 4,850,164 | 7/1989 | McLeod | 52/187 X |
| 4,869,034 | 9/1989 | Hammond | 52/187 X |
| 5,058,339 | 10/1991 | Krstovic | 52/187 |
| 5,163,491 | 11/1992 | Smith | 52/187 X |

*Primary Examiner*—Wynn E. Wood
*Attorney, Agent, or Firm*—Pitts & Brittian

[57] ABSTRACT

A stairset for the fabrication of a spiral stairway on-site, and a method for the assembly of the stairset. This stairset includes a central support to receive spacers to position a plurality of stair tread units at a selected separation (riser height), the stair treads extending horizontally outward. Further, components for a banister (handrail) are a plurality of segments, being a selected number for each stair tread unit, that are threaded upon a cable. The cable is provided on at least one end with means for tensioning, with final tensioning after general assembly of components (post-tensioning). A plurality of balusters are attached to, and extend downwardly from, at least a portion of segments of the resultant banister to be fastened to distal ends of the stair tread units. Specifically, the same number of balusters join the selected number of banister segments for each stair tread. The combination of these components permits the construction of a spiral stairway from substantially standard elements for most combinations of number of treads, total height of the stairway, etc.

20 Claims, 6 Drawing Sheets

NON-LAMINATED, SELF-CONFIGURING, VARIABLE PITCH SPIRAL STAIRSET AND METHOD OF FABRICATING SPIRAL STAIRWAY

TECHNICAL FIELD

This invention relates generally to spiral stairsets having stair treads, handrails and balusters for the fabrication of spiral stairways, and more particularly to a spiral stairset wherein components are not laminated, and the stairset has a banister that is self-configuring by post-tensioning of elements thereof to form a spiral stairway. Further, the invention relates to the method of fabrication of a stairway either on- or off-site with the stairset of the present invention wherein many components are off-the-shelf for ease in the ready fabrication of the stairway.

BACKGROUND ART

Spiral stair units are of convenience when access is needed between two floor levels but there is insufficient space for conventional stairs using either straight runs of treads (and risers) or a combination of shorter straight runs plus an intermediate landing(s). Further, spiral stair units are often utilized to provide an interesting interior design when there is needed access between two levels. While such spiral units can be utilized in industrial applications (usually all-metal structures), the present invention is more applicable to residential applications and is generally of wood construction.

Spiral stair units, as well as circular stair units, are most often constructed using lamination techniques to construct handrails (also called banisters) for the support of stair treads. This permits the preforming of the spiral configuration of these elements. Such fabrication must be accomplished in a factory remote from the site of use of the finished product. Further, these elements are usually joined at the factory using the multiplicity of spindles or balusters and the stair treads joining a central support and, in some constructions, to a preformed stringer (as for a circular stair unit). Each stairway unit is essentially custom built since the total spacing between floor levels may vary as well as the size and number of treads. The entire unit then must be shipped to, and installed at, the ultimate site of use. This is a rather cumbersome effort of shipping and installation.

There are some spiral (and circular) stair units that can be fabricated on-site, thereby reducing the problem of shipping of a large object. One such unit is that described in U.S. Pat. No. 3,418,770 issued to T. Allmand on Dec. 31, 1968. The stair unit of that patent has stair treads cantilevered from a central post, upright balusters, and a segmented handrail. Each segment of the handrail is a solid bar, and mechanical connection is made between ends of each segment.

Another spiral staircase that can be constructed on-site is that described in U.S. Pat. No. 3,491,498 issued to W. Hughes on Jan. 27, 1970. This unit utilizes a segmented and spiral central support from which stair treads are cantilevered. The central support is made up of segments, one each for between a pair of stair treads. Tensionable cables thread through these central support segments, and the stair treads, which strengthen the structure when tensioned.

U.S. Pat. No. 4,869,034 describes a sectional circular staircase. In this construction, both the stringers (outside and inside), as well as the banisters, are made up of a plurality of blocks strung together with cables. The blocks of the banisters and stringers are mitered in two directions at both ends to permit a pre-determined formation of the banisters. The cables, when tensioned, provide stiffness to the respective portions of the stairs. Spaced horizontal treads join the inside and outside stringers in this design. This design permits the construction of the circular stair unit on-site. However, the construction does not lend itself to the fabrication of a spiral stairway. In addition, each component of the unit must be custom-designed to achieve a selected total height, tread width and angle of the turn of the circular stairway.

Accordingly, it is an object of the present invention to provide a stairset which can be easily assembled into a spiral stairway on site from substantially "off-the-shelf" prefabricated components so as to achieve convenience in shipping and movement at the site, and yet permit off-site fabrication if desired.

Another object of the present invention is to provide a stairset wherein components forming a banister are a multiplicity of substantially standard and preformed segments threaded by a cable, the cable having means for post-tensioning, with distal ends of stair treads being joined to the banister with at least one baluster.

A further object of the present invention is to further provide a stairset for a spiral stairway wherein proximal ends of stair tread units are separated by spacers in a central column of the spiral, and distal ends are each separated from each other with braces to provide proper and rigid support of the distal ends, the spacers and braces providing for the riser height of the stair tread units for a selected spiral stairway.

It is also an object of the present invention to provide a method for readily assembling a spiral stairway on- or off-site using a stairset having a banister fabricated from a plurality of segments threaded by a cable whereby post-tensioning of the cable provides rigidity to the banister, and distal ends of stair treads extending from a central support are joined to the banister with at least one baluster.

Also, it is an object of the present invention to provide a stairset for a spiral stairway, and a method for assembly, that utilizes a segmented banister wherein there are a selected whole number of segments for each stair tread unit, with a post-tensioned cable threading all segments of the banister to give rigidity to the banister, with there being one baluster attached between each banister segment and a distal end of respective stair treads units whereby the same number of balusters as banister segments connect to each stair tread unit.

Another object of the present invention is to provide a stairset, and method of assembly, that creates a spiral stairway having a unique and aesthetically-pleasing appearance.

These and other objects of the present invention will become apparent upon a consideration of the drawings referenced below together with a complete description thereof.

SUMMARY OF THE INVENTION

In accordance with the present invention, there is provided a stairset for forming a spiral stairway on-site. This stairset includes a central support to receive spacers to position a plurality of stair tread units at a selected separation (riser height), the stair treads extending horizontally outward. Further, components for a banister (handrail) are a plurality of segments, being a selected whole number for each stair tread unit, that are threaded upon a cable. The cable is provided at least at one end with means for tensioning, with final tensioning being effected after general assembly of components (post-tensioning). A plurality of balusters are attached to, and extend from, the resultant banister and are fastened to distal ends of the stair tread units. In a preferred construction, a baluster joins each of the banister segments to a stair tread. The combination of these components permits the construction of a spiral stairway from principally preformed standard elements for most combinations of number of treads, total height of the stairway, etc., with a minimum of modification of components during fabrication.

BEST MODE FOR CARRYING OUT THE INVENTION

Figure 1:
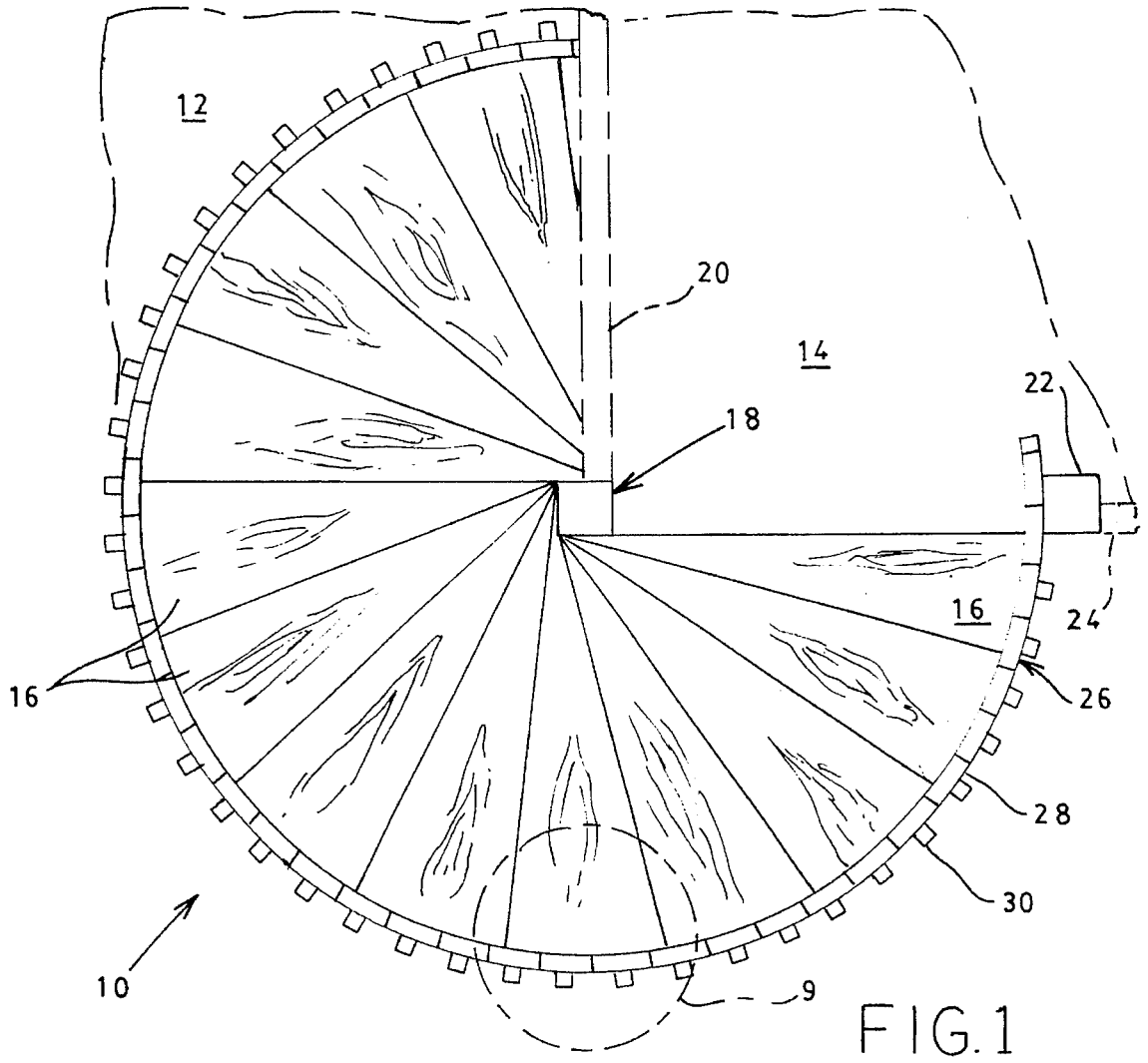
FIG. 1 is a top view of a spiral stairway constructed according to the subject stairset and method of construction.

Referring first to FIG. 1, shown therein at 10 is a spiral stairway fabricated according to the present invention. This figure, as well as FIGS. 3–5 and 9, illustrate a stairway having the banister on the right as a user ascends. It will be recognized that the banister segments can be used for a left- or right-handed banister. While other materials could be used, it is intended that this stairset 10 is fabricated primarily from wood. As indicated, this stairway 10 is intended to extend from one floor level 12 to a second floor level 14. There are a plurality of stair tread units 16 separated at a selected height (riser height), as further shown in FIG. 2, that are oriented spirally around a central column or post 18. Conventionally this spiral is about two-hundred seventy degrees (270°); however, it can have any selected amount of turn in the spiral. The number of stair tread units 16 will depend upon the spacing between the floor levels 12, 14 and the selected tread width and riser height.

The column be can extend above the upper floor 14 and can, for example, support the end of a security rail 20. This could, alternatively, be a wall. Further, there is a upper newel post 22 extending up from the floor level 14 which can support the end of a further security rail 24 or, alternatively, a wall. As will be discussed below, this upper newel post 22 is the upper terminus for a handrail or banister 26 for the stairway 10. As will be discussed in detail hereinafter, the banister 26 is made up of a plurality of segments 28 threaded on a tensioned cable, and these segments 28 are joined to stair tread units 16 with balusters 30.

Figure 2:
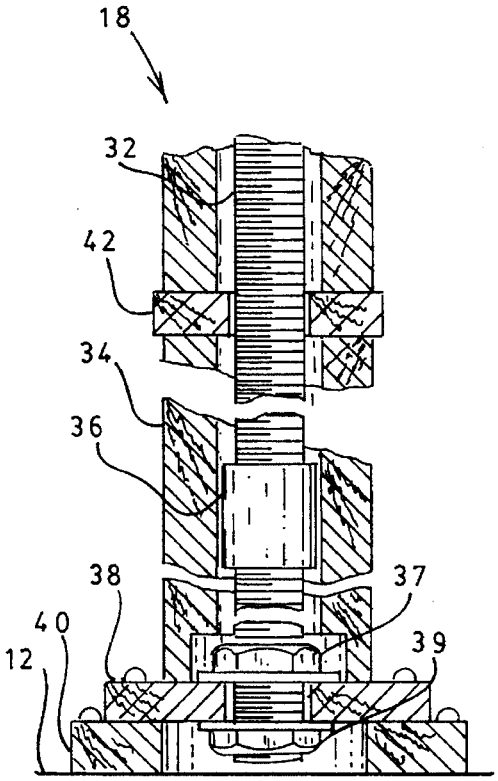
FIG. 2 is a cross-sectional view of a central column of the stairway of FIG. 1, partially cut away, showing the mounting of stairtread units thereon and their spacing, together with a typical base support.

Referring now to FIG. 2, the column 18 has a center member 32 and circumscribing spacers 34. The center member 32 can be a threaded rod (completely threaded as illustrated or only threaded on the ends), a pipe having threaded ends, or even a tensionable cable. As will be understood from a discussion below, this central member 32 provides a means for applying compression to the assembly of spacers 34 and stair treads 42. The spacers 34 determine the riser height of the stairway. A typical riser height (spacer 34 plus thickness of a tread 42) is nine inches; however, a custom height can be chosen. In the embodiment illustrated in FIG. 2, these spacers 34 can be box units or drilled solid material having a square cross section; however, they can have other cross-sectional configurations. For a given installation, the total height between floor levels 12, 14 is uniformly divided to achieve the number of stair tread units and the spacing therebetween. If desired, the center member 32 (pipe, rod or cable) can be made up of sections, with these sections joined as with a coupling 36. Further, the bottom end is securely fastened to a base member 38 as with threaded fasteners 37, 39. A decorative enclosure unit 40 can be used to cover the fastener 39 and secure the base member 38 to the floor 12. The exact details of this column 18 in FIG. 2 are only illustrative of a combination of components to support proximal ends of the stair tread units 16 and it will be recognized that other constructions could be used without departing from the spirit of the present invention.

Figure 3:
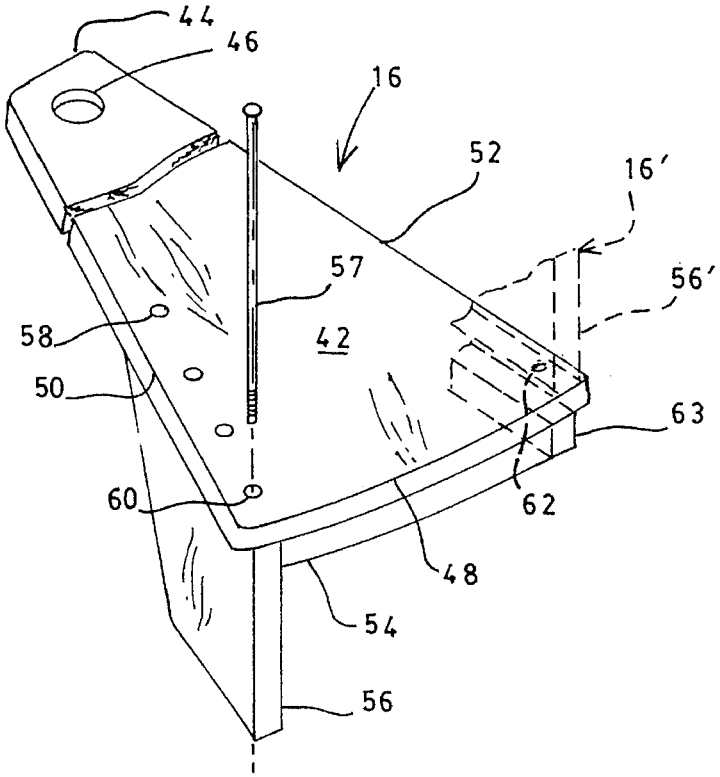
FIG. 3 is a drawing illustrating the details of a typical stairtread unit of the present invention that is mounted on the column of FIG. 2, this being for a stairway having the banister on the right as a user ascends.

Typical details of a stair tread unit 16 of the present invention are illustrated in FIG. 3. Each stair tread unit 16 has a generally truncated, triangular shaped tread 42. The tread 42 has a proximal end 44 provided with an opening 46 to closely receive the afore-mentioned center member 32 (see FIG. 2) of the column structure, and has a distal end 48. The distal end 48 can be curved to match the desired circumference of the spiral configuration. Typically the stair tread 42 is about thirty-one inches from the opening (pivot point) 46, and has a width at the distal end 48 of about seventeen and ¼ inches. Of course, other dimensions can be used for a given stairway. The stair tread 42 has a leading edge 50 and a trailing edge 52. Typically the distal end is provided with a reinforcing member 54 which also provides edge grain (if wood) to retain fasteners for the aforementioned balusters 30 (see FIGS. 1, 7 and 8). Extending downwardly from the tread 42 near the leading edge 50 is a tread bracket member 56 that determines the riser dimension of the stair set 10. This bracket member, by extending toward the proximal end of the tread 42, also acts as a strengthening member for the tread 42. Typically this tread bracket member 56 is joined to the bottom of the tread 42 with glue and a plurality of fasteners passing through holes 58. A further hole 60 is provided that extends through the tread 42 and the tread bracket member 56 for accepting a long fastener 57 to fasten one stair tread unit 16 to a lower tread unit. This is indicated by the dashed lines representing a tread bracket member 56' of a higher tread unit 16' with this long fastener passing through opening 62 near the trailing edge 52 of tread 42. Each stairtread unit typically is provided with a "strut" 63 along a trailing edge of the tread 42. This permits interchange with the bracket member 56 whereby a stair tread unit 16 can be interchanged for either a right- or left-handed stairway. The components of the stair tread unit 16 are typically one and ¼ inches thick.

Figure 4:
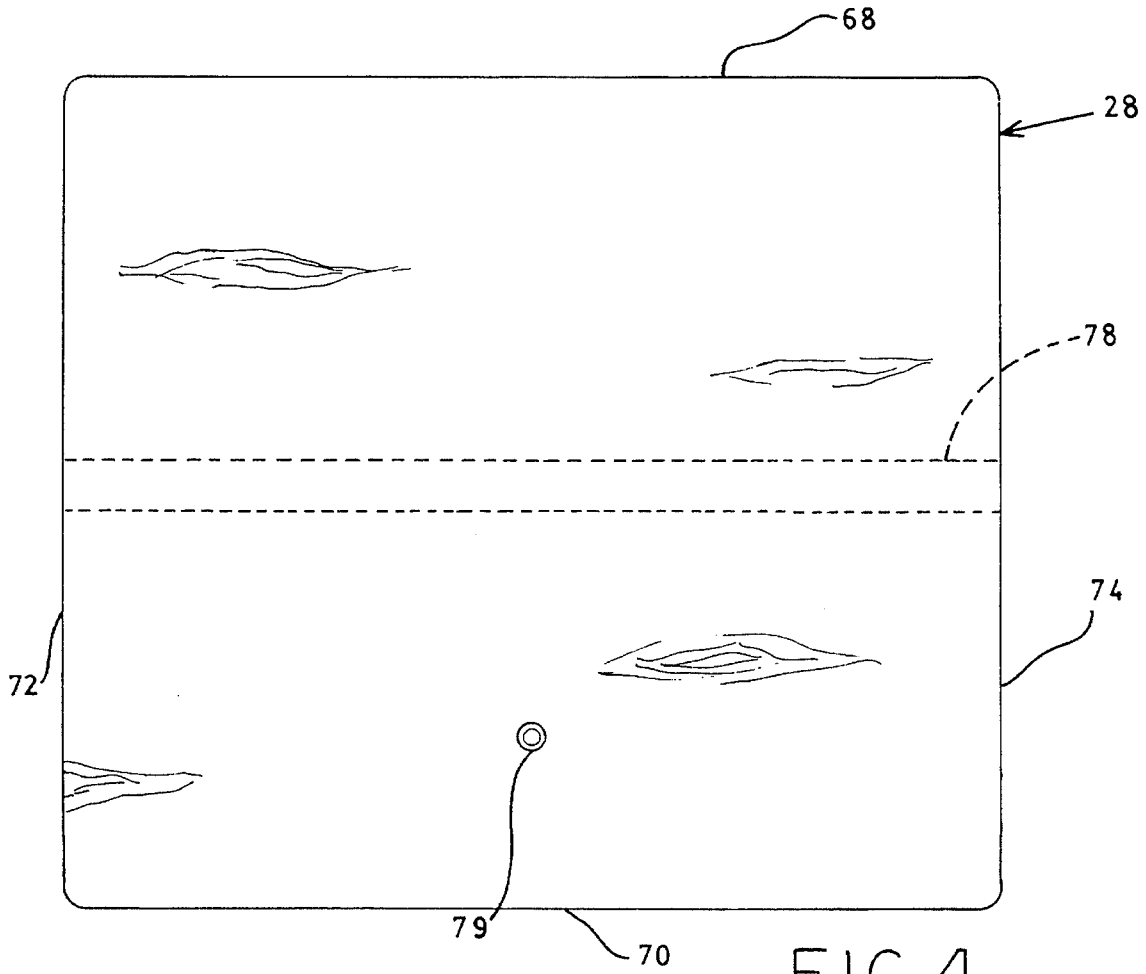
FIG. 4 is a side elevation of one segment of the banister of the stairway of FIG. 1.
Figure 5:
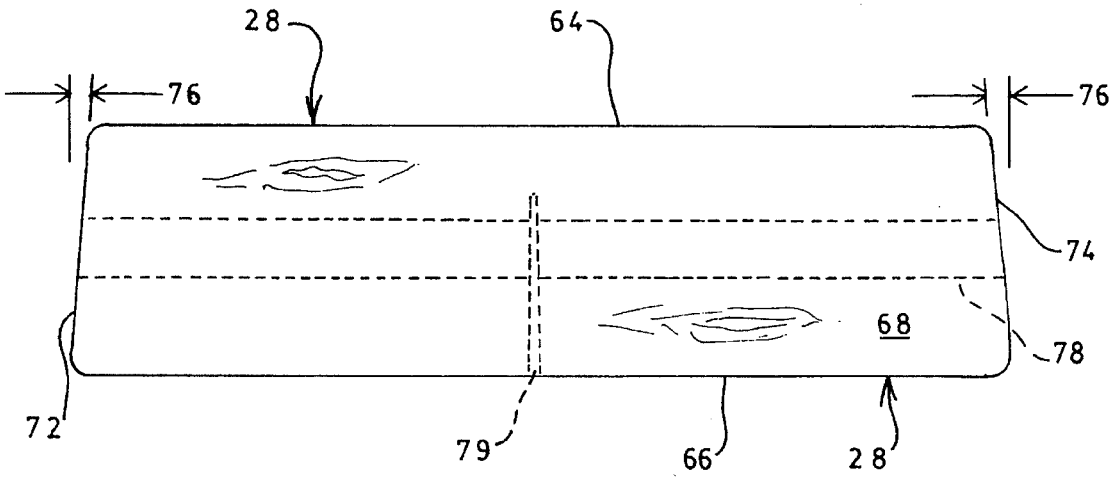
FIG. 5 is a top view of the segment of FIG. 4 showing the end chamfer to accommodate end-to-end abutment to form the curvature for the banister of the stairway.
Figure 6:
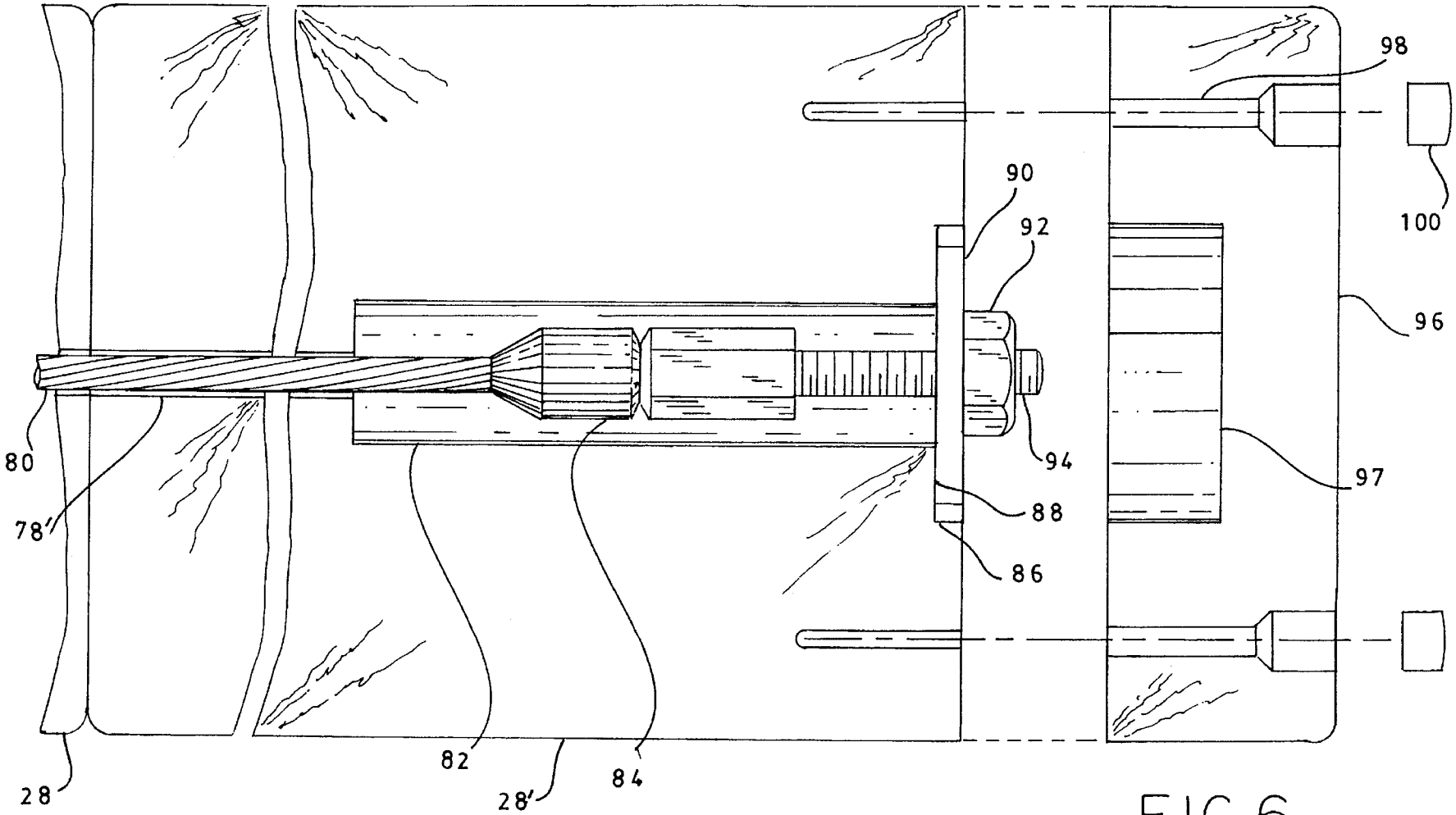
FIG. 6 is a cross-sectional view of an end segment for the banister of the stairway showing a typical mechanism for tensioning the cable that is threaded through all banister segments.

The segments 28 for the fabrication of the banister 26 (see FIG. 1) are detailed in FIGS. 4–6. Referring first to FIGS. 4 and 5, shown therein is a typical central segment 28 in substantially full scale. This segment 28 has substantially rectangular front (facing toward the center of the spiral) and rear surfaces 64, 66 that are parallel. Further, each segment has parallel top and bottom edges 68, 70. End surfaces (along the banister) 72, 74 are chamfered at an angle 76, typically four to five degrees, whereby the joined segments (see FIGS. 1 and 9) form the curved banister 26. As discussed below, the length between the end surfaces 72, 74 is such that there are a selected whole number of segments 28 for each stair tread unit 16. Typically this selected number is three; however, other numbers can be chosen for substantially different sized stairways. This length is typically about five and one/half inches. The height of each segment 28 is typically about five inches. The thickness of the segment 28 is typically the finished thickness of two inch wood stock.

Each of these banister segments 28 is provided with a passageway 78 (typically 5/16 inch) for receiving the afore-mentioned post-tensioned cable (see FIG. 6, for example), the cable being typically ¼ in. diameter. This passageway extends between the ends 72, 74 in a location generally centered between faces 64, 66 and edges 68, 70. In the preferred embodiment the banister segments 28 are each provided with a hole 79 to subsequently receive a fastener for the attachment of a baluster 30 (see FIGS. 7 and 8).

Figure 7:
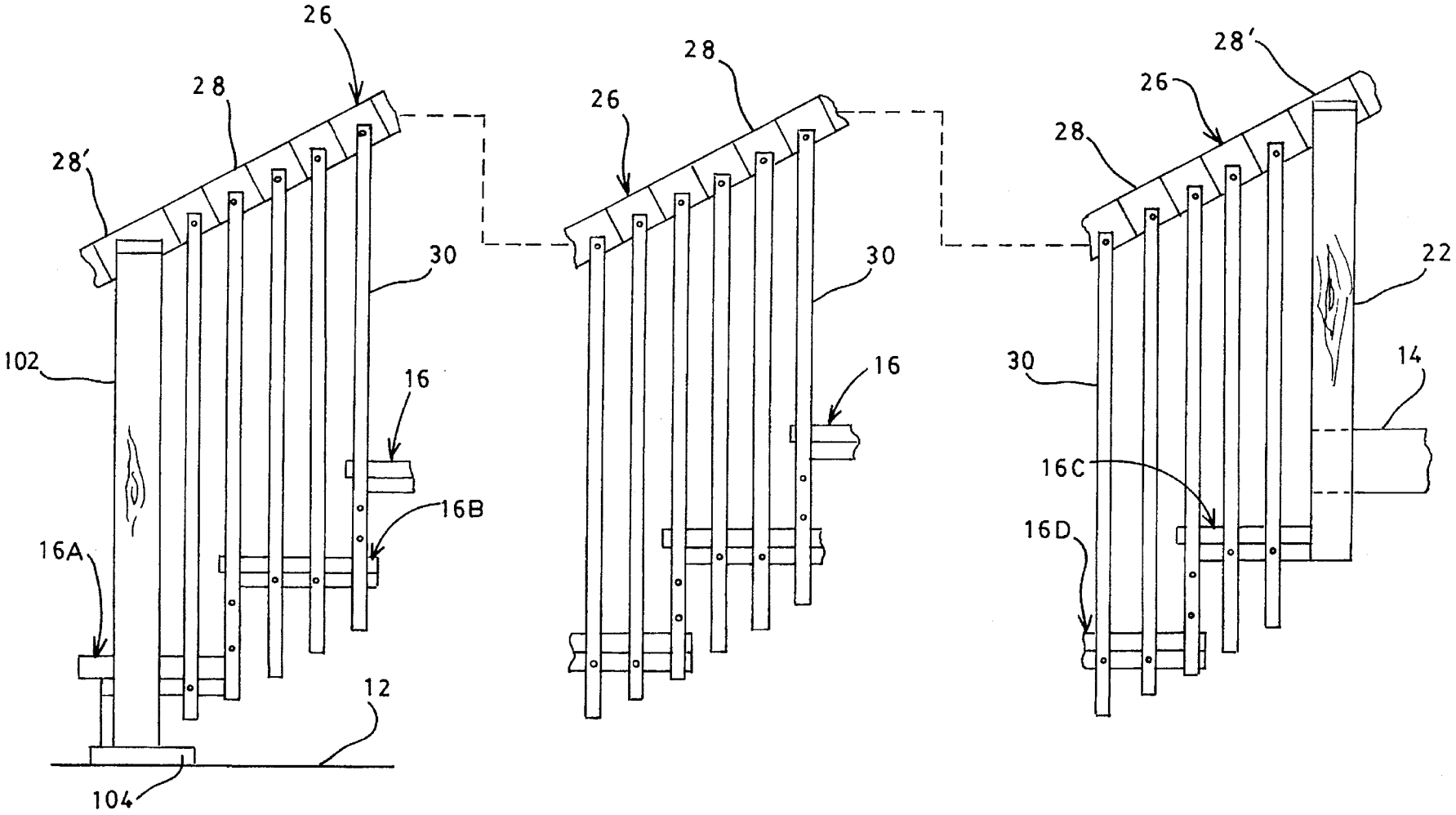
FIG. 7 is a drawing that illustrates the configuration of components of the stairway of FIG. 1 if drawn in two dimension, i.e., unspiraled, to show the relationships of banister segments as joined to stair tread units with balusters.

In order to provide for the tensioning of the cable extending through the passageway 78, modified banister segments 28' are utilized on at least one end of the cable. Two such modified segments 28' are shown in FIG. 7. A cross section of such an end segment 28' is shown in FIG. 6. A multi-sized passageway is provided which includes a portion 78' to receive a cable 80, this portion being in a direction toward an adjacent regular segment 28. An enlarged passageway portion 82 is dimensioned to receive a conventional cable gripping means 84. At an opposite end from that contacting a regular banister segment 28 is a further enlarged portion 86 of the passageway that defines a shoulder 88. This shoulder 88 retains a washer element 90 such that tightening a nut 92 on the threaded member 94 causes the cable 80 to be tensioned. So that this mechanism is hidden after the cable is tensioned, a cap member 96 is attached with fasteners (not shown) through bores 98, and the bores are then sealed with decorative plugs 100. This cap member 96 typically has a recess 97 to receive the afore-mentioned nut 92. It will be recognized, however, that other mechanisms conventionally used to grasp and tension cables can be utilized, and that other means for covering the end of segment 28' can be used.

In order to more fully show the construction of the present invention, FIG. 7 illustrates the stairway as if the spiral is presented in only two dimensions; i.e., the spiral is laid out flat. Accordingly, a portion of the stairway near the lower level 12 is shown at the left, a portion near the upper level 14 is shown at the right, and in the middle is depicted a central portion of the stairway 10. In this embodiment, there are three banister segments 28 for each stair tread unit 16.

The banister 26 is attached to a lower newel post 102 by the securing of end segment 28' thereto with any suitable means. The lower end of this newel post 12 is typically attached to the lowest stair tread unit 16A by any suitable means and then to lower level 12 with a decorative member 104. The bottom stair tread unit 16A forms the first lowest step of the stairway 10, and two balusters 30 (plus the newel post 102) join it to the banister 26 as shown. The third baluster from the newel post 102 joins to the tread bracket member 56 of the next step at stair tread unit 16B, with subsequent stair tread units 16 being similarly connected with balusters 30 to the banister 26.

The upper end of the stairway 10 is similarly constructed, except in reverse. An end segment 28' of the banister 26 is fastened by any suitable means to the upper newel post 22 at the upper level 14. The top stair tread unit 16C then is joined to the banister 26 with three balusters 30, with the baluster farthest from upper newel post 22 joined to the bracket of that stair tread unit 16C. Intermediate sections of the stairway 10 are as shown in the center of this figure.

Figure 8:
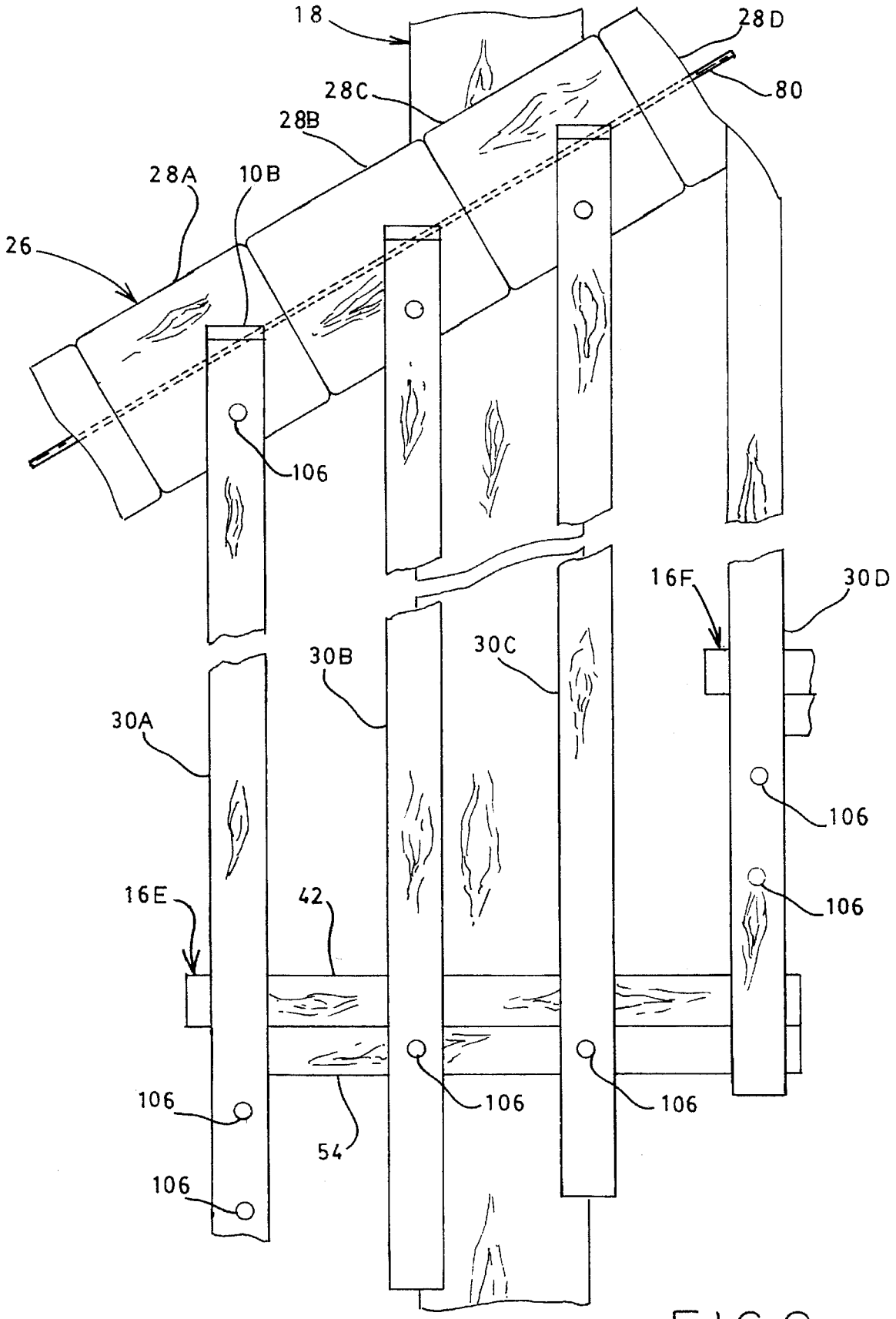
FIG. 8 is a drawing showing one section of the stairway of FIG. 7 enlarged.

Additional information concerning the construction can be obtained by referring to FIG. 8 wherein is shown one section of the stairway be. As in FIG. 7, three banister segments 28, and thus three balusters 30, are illustrated for each stair tread unit 16. In this figure stair tread unit 16E has the tread 42 and its reinforcing member 54. The tread bracket member 56 and strut 63 (see FIG. 3) cannot be seen since they are hidden by the balusters 30A and 30D. The top of baluster 30A is joined to a midpoint along the length of its corresponding banister segment 28A with a fastener (not shown) into the pre-prepared hole 79 (see FIGS. 4 and 5), the fastener typically being hidden by a plug 106. Fasteners (not shown), with plugs 106 fasten a lower end of baluster 30A to the vertical tread bracket member 56. The same fastening is illustrated for baluster 30D. Intermediate balusters 30B, 30C are similarly attached to banister segments 28B and 28C, respectively, at their tops with fasteners and plugs 106. The bottom of balusters 30B and 30C are each attached with fasteners to tread reinforcing member 54, the fasteners being covered with plugs 106. Each of the balusters 30 of the present invention 10, as well as the newel posts 22, 102, typically have a top chamfered edge as at 108 for aesthetics and to minimize interference with hands along the banister 26.

Figure 9:
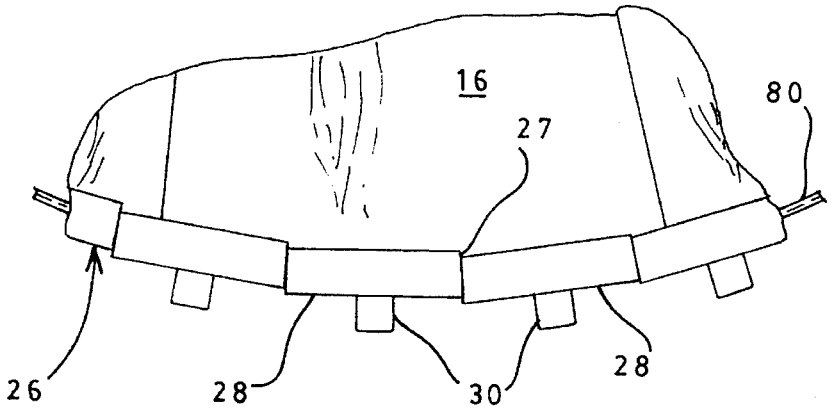
FIG. 9 is a top view of a segment of the banister of the stairway of FIG. 1 taken at the circle indicated with the numeral 9.

Although the curvature of the banister 26 will be understood from the foregoing, a portion thereof is shown in FIG. 9. It can be seen that the cable 80 threads a plurality of segments 28 of the banister 26. Upon tightening of the cable, the chamfered ends of the segments 28 are brought into close contact causing there to be a curvature to the banister 26. Due to the overall curvature of the banister 26, but formed from straight segments, there is a small overlap as indicated at 27, this being exaggerated in this figure. The figure also again illustrates the joining of a vertical baluster 30 to each segment 28.

Figure 10:
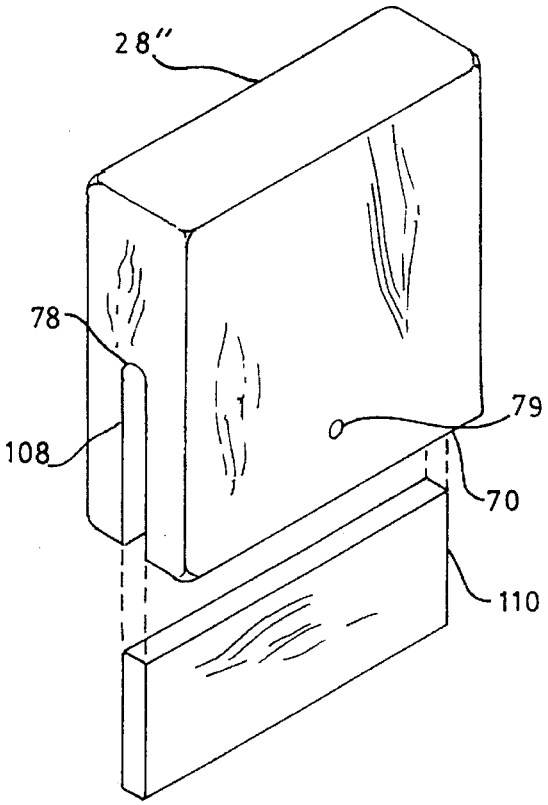
FIG. 10 is an isometric drawing of an optional banister segment that can be used for convenience in the assembly of banister segments upon a cable threaded therethrough.

In order to facilitate the assembly of banister segments 28 on a cable 80, with installation of the cable-gripping element 84 and a tensioning nut 92 on the threaded member 94, a special segment 28" can be used. This segment 28", which typically can be used adjacent segment 28' at the bottom of the banister 26, is illustrated in FIG. 10. The overall dimensions (length, height and thickness) typically can be the same as those of other segments 28. A slot 108 extends upward from the lower edge 70 to the passageway 78, this slot 108 having a width substantially equal to the passageway 78 to permit passage of the cable 80 therethrough. After placement of the segment 28" upon a cable 80 (after the tensioning means are installed), the slot 108 is closed with a plug 110 which can be fastened in place by any suitable means (as with glue).

The present invention 10 is assembled on- or off-site in the following manner, a majority of the individual components having been preformed. The position of the central support member 32 is located, and a pre-selected number of stair tread units 16 and alternating spacers 34 are placed on this central support member 32. Through the use of a conventional compression technique (a nut on a top of the threaded rod, for example) the elements on the central support member are generally pressed together. The stair tread units 16 are "fanned out" around the central support member 18 to approximately their expected final positions. Thereafter, a baluster 30 can be installed at the leading edge of each stair tread unit 16 by loosely attaching the lower end to the upright bracket member 56 (see FIG. 8) of the unit 16.

The various segments 28 and 28' of the banister 26 are assembled on the cable 80, and the tightening means 92, 94 used to bring all segments 28, 28' in close contact, with the end segments 28'. If utilized, the special banister segment 28" of FIG. 10 can be positioned in the string of segments 28 after the tightening means 92, 94 have been installed on the cable 80.

Thereafter, the top stair tread unit 16C (see FIG. 7) is rotated to a proper position and secured. A baluster 30 (equivalent to 30D of FIG. 8) is vertically aligned with the tread bracket member 56 of that first tread unit 16C. The top of that baluster, e.g., 30D, is then loosely fastened to the appropriate segment 28 of the banister 26. Intervening balusters 30 between the fastened baluster and the newel post 22 can be fastened to the reinforcing member 54 and their respective segments 28 at any time.

The next lower stair tread unit 16D is then rotated so that its tread bracket member 56, and the baluster 30 attached to its bracket member 56, is vertically aligned for the baluster 30 to be loosely connected at its top end to a corresponding banister segment 28. With this second tread unit 16D in proper location, the long fastener 57 (see FIG. 3) is passed through the hole 60 near the leading edge 50 of the first tread 16C and through a hole 62 near the trailing edge 52 of the second tread unit 16D. When a strut 63 is utilized, this fastener may pass therethrough. Thereafter, any intervening balusters 30 can be fastened to the strengthening member 54 of the second stair tread unit 16D and their respective banister segments 28.

These steps are repeated for each of the stair tread units 16 to the bottom of the stairway 10. Thereafter the spacers 34 of the column 18 are aligned around the center member 32 (if square, for example, rotated to present an aesthetic appearance) and full compression is applied to the center member 32 to tighten all spacers 34 and stair tread units 16. Final tensioning of the cable 80 is then concluded, and the ends of the banister 26 are attached to the newel posts 22 and 102. Decorative members can then be placed at the bottom of the column 18 and newel post 102, as well as the tightening of all fasteners and the application of appropriate plugs, for improved aesthetics of the completed stairway 10.

Throughout a discussion of a preferred embodiment there is a baluster fastened between each banister segment and the distal end of a corresponding stair tread unit. Thus, if there are three banister segments per stair tread unit, there will be three balusters. However, it will be understood that there may be applications where a lesser number of balusters are needed. Accordingly, only a portion of banister segments will have an attached baluster.

From the foregoing, it will be understood that an improved spiral stair set has been provided that permits the fabrication of a spiral stairway on-site. Substantially standard components can be used to fabricate a stairway to meet most any chosen size of stairway 10. Most of the components that will be seen upon completion are prefinished so that very minimal finishing is required upon total completion of the installation. This stair set provides a stairway having sufficient stability, and exhibits an attractive appearance. The various elements used for this stair set are easily manufactured using simple techniques. It will be understood that the embodiment described above is for a stairway having the banister on the right as a user ascends the stairway. Further, it will be understood that stair tread units can be reversed to provide a stairway having the banister on the left as a user ascends.

Although certain sizes of components are given herein, these are for the purpose of illustrating a typical installation and are not for the purpose of limiting the invention. Rather, the invention is to be limited only by the appended claims and their equivalents.

I claim:

1. A spiral stairway, for being formed on-site from a stairset, for extending from a lower floor level to an upper floor level, said spiral stairway comprising:

a central support column extending vertically from a lower floor level to at least an upper floor level;

a plurality of generally triangular stair tread units extending radially outward from said central support column, said stair tread units rotatable with respect to each other around said central support column and being of a number to equally divide a distance between the lower floor level and upper floor level with a uniform vertical spacing therebetween;

a spiral banister spiralling around said central support column, said banister having a plurality of substantially rectangular segment members and a tensionable member threaded through each segment, said segment members being a select whole number for each stair tread unit; and a vertical baluster joined at an upper end to, and extending downwardly from, said segment members of said banister and joined at a lower end to a corresponding stair tread unit, whereby upon loosening of said tensioning means, said stair tread units remain rotatable with respect to each other around said central support column.

2. The stairway of claim 1 wherein each of said banister segments are beveled on at least one end whereby tensioning of said tensionable member forms said plurality of segments into a curved member for forming said spiral banister.

3. The stairway of claim 1 wherein said central support column comprises:

a center support; and a plurality of spacer elements surrounding said center column support, each spacer element interposed between adjacent stair tread units to establish spacing between said stair tread units.

4. The stairway of claim 3 wherein each stair tread unit comprises:

a substantially triangular stair tread having a leading edge, a trailing edge, a proximal end for being positioned between a pair of said spacer elements and pivotal around said center support, and a distal end for receiving attachment of said lower end of said balusters; and a tread bracket extending along and attached to, and depending from, an under surface of said stair tread proximate said leading edge at said distal end, said tread bracket further providing spacing between adjacent stair tread units and for attachment to a trailing edge of an immediately lower stair tread unit.

5. The stairway of claim 4 wherein said stair tread unit further comprises a reinforcing end block attached to said under surface of said stair tread at said distal end for receiving attachment of said lower end of said balusters.

6. The stairway of claim 1 wherein said banister further comprises a further segment on at least one end, said further segment being substantially rectangular containing tensioning means for tensioning said tensionable member.

7. The stairway of claim 6 wherein said tensionable member is a cable threaded through passageways in said banister segments and said further segment, and said tensioning means comprises a cable-engaging means and tightening means attached to said cable-engaging means for tensioning said cable.

8. The stairway of claim 1 wherein said banister further comprises a further segment at each end, said further segment being substantially rectangular and at each end containing tensioning means for tensioning said tensionable member.

9. The stairway of claim 1 further comprising:

a first vertical newel post attached to the lower floor level;

a second vertical newel post attached to the upper floor lever; and wherein first and second opposite ends of said banister are attached to said first and second newel posts, respectively.

10. A spiral stairway, formed from a stairset, for extending from a lower floor level to an upper floor level, said spiral stairway comprising:

a central support column extending vertically from a lower floor level to at least an upper floor level, said central support column formed from a center support and a plurality of spacer elements surrounding said center support;

a plurality of generally triangular stair tread units extending radially outward from said central support, each said stair tread unit having a proximal end and a distal end, said proximal end rotatable around said center support and separated from an adjacent stair tread unit by one of said spacer elements, said stair tread units rotatable with respect to each other around said central support and being of a number to equally divide a distance between the lower floor level and upper floor level with a uniform vertical spacing therebetween;

a spiral banister spiralling around said central support column, said banister having a plurality of substantially rectangular segment members and a tensionable cable threaded through each segment member, said segment members being a selected whole number for each stair tread unit, at least one end of each of said banister segment members being beveled whereby tensioning of said tensionable cable forms said plurality of segment members into a curved member for forming said spiral banister, said banister further having a substantially rectangular further segment member at each end, said further segment members containing a tensioning means for tensioning said cable;

a first vertical newel post attached to the lower floor level;

a second vertical newel post attached to the upper floor level, with first and second opposite ends of said banister attached to said first and second newel posts, respectively; and a plurality of vertical balusters, each said baluster joined at an upper end to, and extending downwardly from, an outwardly-directed side surface of a segment member of said banister and joined at a lower end to a corresponding stair tread unit, whereby upon loosening of said cable, said stair tread units remain rotatable with respect to each other around said central support column.

11. The stairway of claim 10 wherein each stair tread unit comprises:

a substantially triangular stair tread having a leading edge, a trailing edge, a proximal end for being positioned between a pair of said spacer elements and pivotal around said center support, and a distal end for receiving attachment of said lower end of said balusters;

a tread bracket attached to and extending along, and depending from, an under surface of said stair tread proximate said leading edge at said distal end, said tread bracket further providing spacing between adjacent stair tread units and for attachment to a trailing edge of an immediately lower stair tread unit; and a reinforcing end block attached to said under surface of said stair tread at said distal end for receiving attachment of said lower end of said balusters.

12. The stairway of claim 10 further comprising a strut extending along and fastened to said under surface of said tread proximate said trailing edge whereby said strut and said tread bracket can be interchanged for right- and left-handed stairways.

13. The stairway of claim 10 further comprising an elongated fastener passing through said stair tread and stair tread bracket proximate said distal end of said stair tread for attaching said stair tread unit to a lower stair tread unit of said stairway after positioning of said stair tread units at selected positions around said central support column.

14. A method for assembling a stairway on-site that extends from a lower floor level to an upper floor level from a stairset having a plurality of stair tread units and a banister, said stair tread units each having a downwardly-extending bracket extending along a leading edge, and said banister having a plurality of substantially rectangular segments threaded by a tensionable cable, said segments being of a selected whole number for each stair tread unit, each said segment having at least one beveled end to contact an adjacent segment, said method comprising:

forming a central support column extending from a lower floor level to at least an upper floor level, said central support column comprising a central member threaded through alternating spacer elements, said spacer elements having a height corresponding to said stair tread unit bracket, and through proximal ends of said stair tread units;

arranging said stair tread units in a spiral array around said central support column;

fastening a lower end of an upright primary baluster to said brackets of each said stair tread units;

rotating a top stair tread unit to be adjacent the upper floor level, and attaching said top stair tread unit in position;

fastening a top end of said upright primary baluster of said top stair tread unit to an outwardly-directed surface of a corresponding segment of said banister;

rotating a next to said top stair tread unit to a position partially beneath said top stair tread unit until said upright primary baluster of said next to said top stair tread unit is positioned proximate to a corresponding segment of said banister;

fastening a top end of said upright primary baluster of said next to said top stair tread unit to an outwardly-directed side surface of its corresponding segment of said banister;

fastening a leading edge of said top stair tread unit to a trailing edge of said next to the top stair tread unit;

continuing positioning and fastening stair tread units and primary balusters between stair tread units and outwardly-directed side surfaces of said segments of said banister to complete all stair tread units of said stairway;

attaching top ends of balusters intermediate said primary balusters to outwardly-directed side surfaces of segments of said banister, and lower ends to said stair tread units so as to be parallel with said primary balusters;

tensioning said cable threaded through said banister segments to make said banister rigid and of spiral configuration; and fastening a lower end of said banister to a lower newel post at the lower floor level and an upper end of said banister to an upper newel post at the upper floor level, whereby upon loosening of said cable, said stair tread units remain rotatable with respect to each other around said central support column.

15. The method of claim 14 further comprising the step of compressing said central support column after positioning of said stair tread units to bring said spacer elements and stair tread units into frictional contact to limit further rotation of said stair tread units.

16. The method of claim 14 further comprising;

providing recesses for heads of fasteners used in the fabrication of said stairway; and covering said heads of said fasteners with decorative plugs after all fasteners are fully tightened.

17. A banister for use on a spiral stairway that extends from a lower floor level to an upper floor level, said stairway having a plurality of stair tread units extending radially from a central support column said banister comprising:

a plurality of substantially equally-sized first banister segments having rectangular parallel side surfaces, parallel top and bottom surfaces, and rectangular end surfaces to abut adjacent first banister segments, at least one end surface oriented at an angle to said side surfaces to achieve a curve when said plurality of first segments abut, each said first banister segments provided with a passageway extending between end surfaces and positioned midway between said top and bottom surfaces and midway between said side surfaces, there being a selected whole number of said first banister segments greater than one corresponding to each of the stair tread units;

a cable member extending through said passageway of each said first banister segments, whereby said first banister segments are rotatable with respect to each other about said cable member;

a further banister segment on at least one end of said cable member containing means for tensioning said cable after installation through said first banister segments;

a plurality of substantially vertically oriented baluster members each having one end attached to one of said first banister segments on an outwardly-directed surface proximate a midpoint between said end surfaces, said baluster members having a second end for attachment to one of the stair tread units to establish a height of said banister above the stair tread units; and attachment means at ends of said banister for attachment at the upper and lower floor levels.

18. The banister of claim 17 wherein both end surfaces of said first banister segments are angled with respect to said side surfaces and wherein a substantially rectangular further banister segment is provided at both ends, each further banister segment containing means for tensioning said cable and having an angled end surface to abut a confronting first banister segment, and wherein said further banister segments provide for attachment to the upper and lower floor levels.

19. The banister of claim 17 wherein said whole number of said first banister segments for each stair tread unit is three, and said end surfaces are at an angle of about four to five degrees with respect to said side surfaces.

20. The spiral stairway of claim 10 wherein said whole number of said first banister segments for each stair tread unit is three, and said at least one end of each banister segment is beveled at an angle of about four to five degrees with respect to side surfaces of said segment.

* * * * *